United States Patent [19]

Oishi

[11] Patent Number: 4,509,355

[45] Date of Patent: Apr. 9, 1985

[54] APPARATUS FOR FORMING A SHEET METAL PRODUCT HAVING AN OPENING

[75] Inventor: Masatoshi Oishi, Hiroshima, Japan

[73] Assignee: Mazda Motor Company, Hiroshima, Japan

[21] Appl. No.: 424,313

[22] Filed: Sep. 27, 1982

[30] Foreign Application Priority Data

Sep. 29, 1981 [JP] Japan ..... 56-155482

[51] Int. Cl.[3] ..... B21D 28/00; B21D 28/32

[52] U.S. Cl. ..... 72/325; 72/464; 225/103

[58] Field of Search ..... 72/324, 325, 464, 465, 72/294, 340, 350, 359; 225/103, 95, 1; 83/568-570

[56] References Cited

U.S. PATENT DOCUMENTS

| | | | |
|---|---|---|---|
| 402,240 | 4/1889 | Hayes | 72/325 |
| 445,603 | 2/1891 | Turner | 72/325 |
| 833,470 | 10/1906 | Lipowsky | 83/570 |
| 2,274,835 | 3/1942 | Koch | 72/350 |
| 2,308,998 | 1/1943 | Misfeldt | 72/464 |
| 2,460,483 | 2/1949 | Berliner | 72/294 |
| 3,190,094 | 6/1965 | Kutas | 225/103 |
| 3,267,780 | 8/1966 | Roth | 83/568 |
| 4,277,996 | 7/1981 | Spengler | 83/568 |

FOREIGN PATENT DOCUMENTS

| | | | |
|---|---|---|---|
| 54-131539 | 9/1979 | Japan | 72/325 |

*Primary Examiner*—Daniel C. Crane

*Attorney, Agent, or Firm*—Fleit, Jacobson, Cohn & Price

[57] ABSTRACT

A process of manufacturing a sheet metal product including an opening surrounded at least partially by a drawn area, the process comprising steps of providing a pair of drawing dies, one having a drawing punch and the other having a drawing cavity adapted for cooperation with the drawing punch, putting a blank of sheet metal between the drawing dies, advancing one of the dies toward the other so that the blank is drawn by the punch and the cavity. The process includes a step of forming a slit in the blank by tearing the blank at an area which corresponds to the opening and which is adjacent to an area where the blank is stretched during the drawing step.

3 Claims, 7 Drawing Figures

APPARATUS FOR FORMING A SHEET METAL PRODUCT HAVING AN OPENING

The present invention relates to a process of drawing a sheet metal and more particularly to a sheet metal drawing process for producing a sheet metal part having an opening.

In automobile industries, panel members of automobiles are generally produced by pressing sheet metal blanks. Many of such panel members are formed through drawing techniques in which sheet metal blanks are locally stretched in some areas and locally shrunk in some other areas. When sheet metal blanks are thus drawn, there must be produced a flow of material from those areas where the blanks are to be shrunk to those areas where the blanks are to be stretched because, otherwise, the blanks may possibly be broken at the stretching areas and wrinkled at the shrinking areas.

Conventionally, in case where end products are of such configurations having openings therein, the blanks are formed at the areas corresponding to the openings with slits so that the flow of materials is readily allowed to the stretching area. The slits may be formed in advance or during the drawing process by shear cutting edges. In the conventional processes, however, problems have been encountered in that powdery metal dusts are produced in the processes of forming the slits and cause fine depression marks in the end products. Describing that condition in more detail, where a sheet metal is cut by cooperating shearing edges, a fraction of the thickness of the sheet is clearly cut by the shearing edges but the remainder of the sheet thickness is broken as soon as such fraction is cut so that a rough edge is produced in the remainder portion. When the shearing edges are further advanced, the rough edge is smoothly cut by the shearing edges producing the aforementioned powdery metal dusts. Such metal dusts may stick on the surface of the sheet metal blank and cause depression marks thereon. In order to avoid such problems, expensive facilities or additional steps must be provided for removing the powdery metal dusts.

It is therefore an object of the present invention to provide a process of drawing a sheet metal in which slits can be formed without producing powdery metal dusts.

Another object of the present invention is to provide a sheet metal drawing process in which possibilities of depression marks on end products can be effectively avoided.

A further object of the present invention is to provide a method of forming a slit in a sheet metal blank in a sheet metal drawing process without producing powdery metal dusts.

According to the present invention, the above and other objects can be accomplished by a process of manufacturing a sheet metal product including an opening surrounded at least partially by a drawn area comprising the steps of providing a pair of drawing dies, one having drawing punch means and the other having drawing cavity means adapted for cooperation with said drawing punch means, putting a blank of sheet metal between said drawing dies, advancing one of said dies toward the other so that the blank is drawn by said punch means and said cavity means, the process being characterized by a step of forming a slit in the blank by tearing the blank at an area which corresponds to said opening and which is adjacent to an area where the blank is stretched during the drawing step. The tearing step may preferably be carried out while the drawing step is proceeding. Alternatively, the tearing step may be made prior to the drawing step.

Where the tearing step is to be carried out during the drawing step, one of the drawing dies may be provided with tearing projection means and the other die with receptacle means having recess means for loosely receiving said tearing projection means so that the tearing projection means penetrates into the recess means tearing the blank when the drawing dies are brought toward each other. The receptacle means may be yieldably supported by the die through resilient means so that it can be pushed into the die when the projection means is further advanced after the blank has been torn. Thus, the present invention also provides an apparatus for carrying out the aforementioned process.

The above and other objects and features of the present invention will become apparent from the following descriptions of a preferred embodiment taking reference to the accompanying drawings, in which:

FIG. 3(*b*) is a fragmentary perspective view showing an example of the tearing projection.

Figure 1:
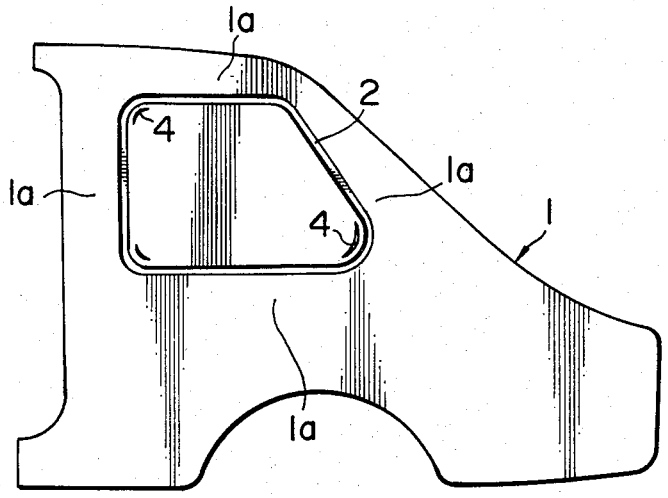
FIG. 1 is a side view of an automobile rear fender panel to which the process of the present invention can be applied.
Figure 2:
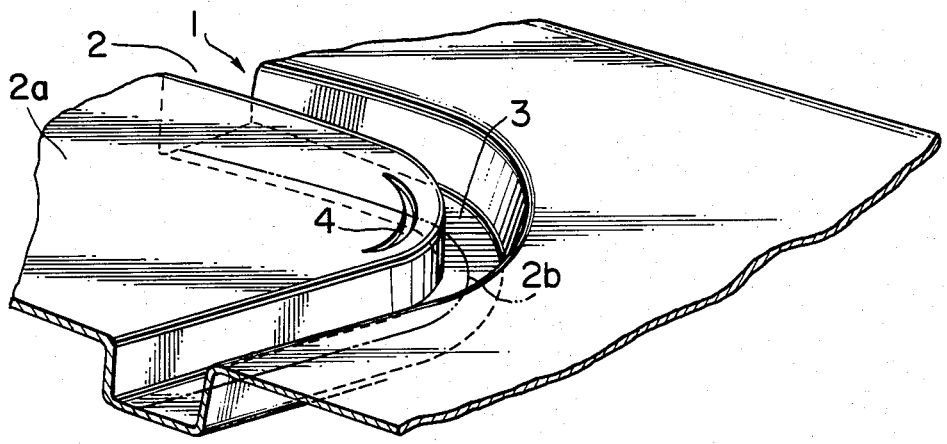
FIG. 2 is a fragmentary perspective view of the rear fender panel showing part drawn in accordance with the process of the present invention.

Referring now to the drawings, particularly to FIGS. 1 and 2, there is shown a press-formed sheet metal workpiece 1 for producing an automobile rear fender panel. The workpiece 1 is formed with a recess 2 drawn from a planar blank. An window opening is formed in a succeeding punching process by cutting the bottom sheet 2*a* of the recess 2 along a phantom line 2*b* shown in FIG. 2 leaving a marginal flange 3 along the periphery of the opening. In forming the recess 2, the material of the blank is drawn and, at the corner portions of the recess 2, the material is subjected to elongations of substantial extent. In order to allow the material of the sheet metal to flow into the areas where significant elongations are produced, slits 4 are formed in the bottom 2*a* of the recess 2.

Figure 3A:
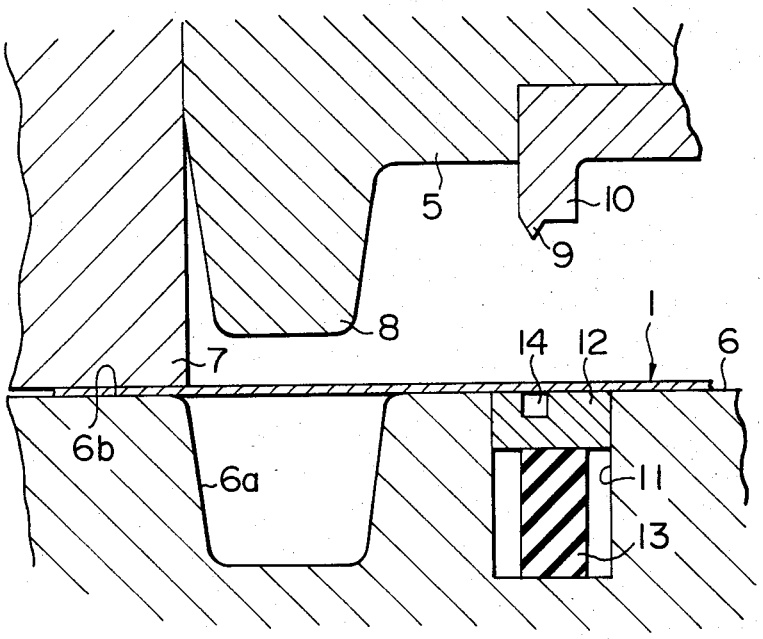
FIG. 3(*a*) is a sectional view showing the drawing dies in accordance with one embodiment of the present invention.
Figure 3B:
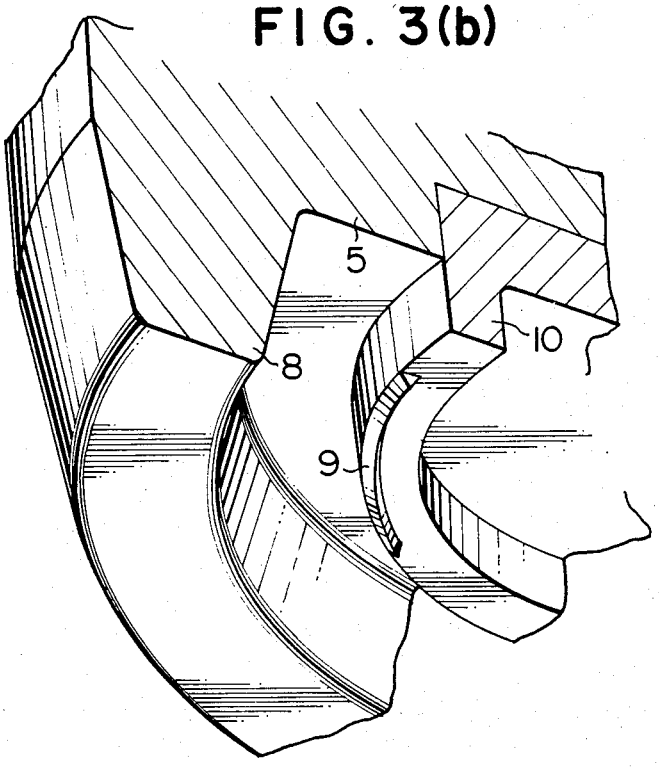

FIG. 3(*a*) shows an example or drawing apparatus with which the process of the present invention can be carried out. The apparatus includes an upper die 5, a lower die 6 and a blank holder 7. The upper die 5 has a forming projection 8 and the lower die 6 is formed with a die recess 6*a* which cooperates with the forming projection 8. The lower die 6 further has a flat surface 6*b* which is adapted to cooperate with the blank holder 7 to hold a sheet metal blank 1 therebetween.

The upper die 5 is provided with a slitting punch 10 having suitably located projections 9. Each of the projections 9 may be of an arcuate configuration as shown in FIG. 3(*b*) so that it conforms with the desired shape of the corresponding slit 4. The lower die 6 is formed at locations corresponding to the projections 9 on the slitting punch 10 with recesses 11, only one of which is shown in FIG. 3(*a*). In each of the recesses 11, there is disposed a receptacle 12 which is yieldably supported by a resilient rubber cushion 13. The receptacle 12 is formed with a recess 14 which is adapted to loosely receive the projection 9 on the slitting punch 10. The receptacle 12 and the rubber cushion 13 are so formed that under a normal position the upper surface of the receptacle 12 is substantially flush with the top surface of the die 6 but when a downward force is applied thereto the receptacle 12 can be pushed into the recess 12 deforming the rubber cushion 13.

Figure 4:
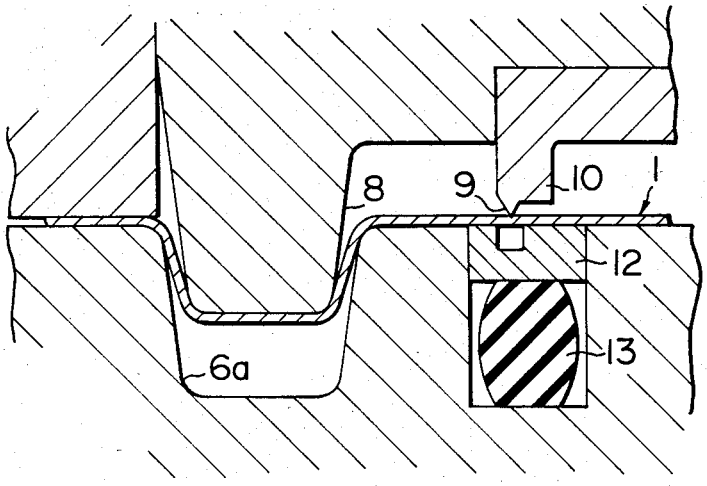
FIGS. 4 through 6 show sequential steps of the drawing process in accordance with one embodiment of the present invention.

In operation, the sheet metal blank 1 is placed on the top surface of the lower die 6 and the upper die 5 and the blank holder 7 are moved downwards until the blank holder 7 grasps the blank 1 with the surface **6*b* on the lower die 6 as shown in FIG. 3**(*a*). Then, the upper die 5 is further moved downwards so that the forming projection 8 thereon is formed into the cavity **6*a* of the lower die. Thus, the blank 1 is started to be formed as shown in FIG. 4. In the position shown in FIG. 4, the projection 9 on the slitting punch 10 is just in contact with the surface of the blank 1**.

Figure 5:
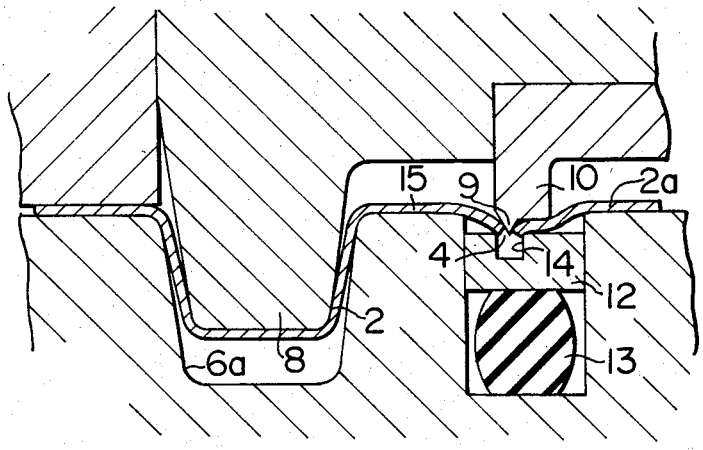

As the upper die 5 is moved further downwards, the blank 1 is deformed by the projection 9 on the slitting punch 10 and finally torn to form the slit 4 as shown in FIG. 5. It should be noted that since the projection 9 is loosely received by the recess 14, the blank 1 will not be sheared but will be torn. Therefore, it is unlikely that powdery metal dusts be produced as in the case of shear cut. The tearing of the blank 1 will unfailingly occur since the blank 1 is supported by the receptacle 12 and the blank 1 is subjected to a tension which is produced through the drawing process.

Figure 6:
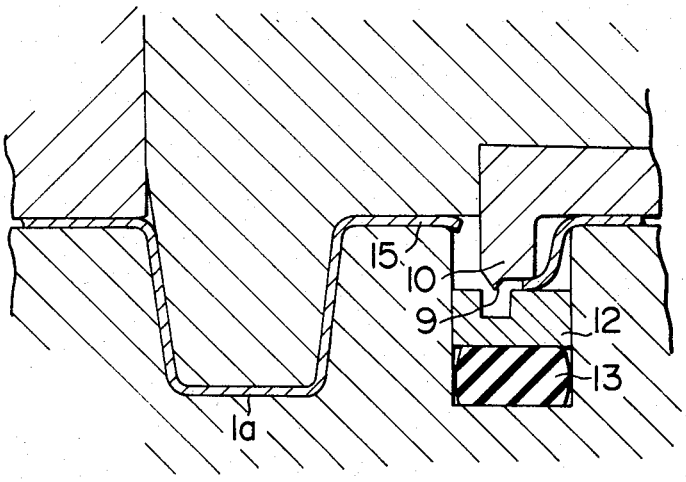

The upper die 5 is then further moved downwards to the position shown in FIG. 6. In this course of operation, the material in the area 15 is drawn toward the recess **6*a* to compensate for the elongation of the material. The workpiece 1 is then punched to remove the material in the bottom 2*a* of the recess 2 along the phantom line 2*b* in FIG. 2** to form an window opening.

The invention has thus been shown and described with reference to a preferred embodiment, however, it should be noted that the invention is in no way limited to the details of the illustrated structures but changes and modifications may be made without departing from the scope of the appended claims. For example, the forming projection may be formed on the lower die and the upper die may then be formed with a corresponding forming recess. Similarly, the slitting punch may be provided on the lower die and the receptacle on the upper die.

I claim:

1. An apparatus for manufacturing from a blank of sheet metal a sheet metal product including an area which is to be cut off in a later stage to form an opening which has at least one corner portion surrounded by a drawn area, said apparatus comprising: a pair of cooperating complementary dies, one die having drawing punch means and the other die having drawing cavity means for drawing a blank of sheet metal, said punch being movable along an axis towards said cavity, said punch and cavity having a noncylindrical shape taken in cross-section transverse to said axis so that the shape of each punch and cavity is defined by a working surface comprising side surfaces extending along said axis with each of said side surfaces being connected at a corner, one of said dies being provided in said area which is to be cut off and adjacent to said corner portion with tearing projection means located only at said corners of the side surfaces and projecting toward the other die, at a portion in which material of the blank is stretched while it is being drawn, the other die being provided with receptacle means supported by said other die through resilient support means and having recess means for loosely receiving said tearing projection means so that the blank is torn by said tearing projection means when it is being drawn.

2. Apparatus in accordance with claim 1 in which said resilient support means is a resilient rubber disposed in said recess means in the other die.

3. Apparatus in accordance with claim 1 in which said tearing projection means is of an arcuate configuration and provided on slitting punch means which is attached to said one die so that said tearing projection means is inserted into said recess means in the receptacle means when the blank is being drawn.

* * * * *